US011519235B1

(12) United States Patent
Al Ahmari et al.

(10) Patent No.: US 11,519,235 B1
(45) Date of Patent: Dec. 6, 2022

(54) DOWNHOLE CERAMIC DISK RUPTURE BY JETTING WITH FLUIDS AND SOLIDS

(71) Applicant: SAUDI ARABIAN OIL COMPANY, Dhahran (SA)

(72) Inventors: Abdulrahman Al Ahmari, Qatif (SA); Mohammed Al Dabbous, Qatif (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 17/405,541

(22) Filed: Aug. 18, 2021

(51) Int. Cl.

| | |
|---|---|
| ***E21B 29/00*** | (2006.01) |
| *E21B 43/114* | (2006.01) |
| *E21B 10/60* | (2006.01) |
| *E21B 7/18* | (2006.01) |

(52) U.S. Cl.
CPC ..... *E21B 29/00* (2013.01); *E21B 7/18* (2013.01); *E21B 10/60* (2013.01); *E21B 43/114* (2013.01)

(58) Field of Classification Search
CPC . E21B 7/18; E21B 10/60; E21B 29/00; E21B 43/114; E21B 43/29
See application file for complete search history.

(56) References Cited

U.S. PATENT DOCUMENTS

| | | | |
|---|---|---|---|
| 3,831,680 | A | 8/1974 | Edwards et al. |
| 4,605,074 | A | 8/1986 | Barfield |
| 5,924,696 | A | 7/1999 | Frazier |
| 6,323,307 | B1 | 11/2001 | Bigg et al. |
| 7,661,480 | B2 | 2/2010 | Al-Anazi |
| 9,194,209 | B2 | 11/2015 | Frazier |
| 9,624,743 | B2 | 4/2017 | Al Dabbous |
| 10,107,070 | B2 | 10/2018 | Yong et al. |
| 2007/0062690 | A1 | 3/2007 | Witcher |
| 2017/0022783 | A1* | 1/2017 | Yong ..... E21B 34/10 |

* cited by examiner

*Primary Examiner* — Robert E Fuller
*Assistant Examiner* — Lamia Quaim
(74) *Attorney, Agent, or Firm* — Bracewell LLP; Constance Gall Rhebergen

(57) ABSTRACT

Methods and systems are provided removing the functionality of a ceramic disk installed in a wellbore during oil and gas well completion and production activities. More specifically, the disclosure relates to rupturing a ceramic disk with a jet of fluids. The jetting fluid is directed towards the disk with a jetting device lowered into the wellbore. The jetting fluid comprising a fluid with entrained solids.

18 Claims, 2 Drawing Sheets

DOWNHOLE CERAMIC DISK RUPTURE BY JETTING WITH FLUIDS AND SOLIDS

FIELD

This disclosure relates to systems and methods for downhole tool removal. More specifically, this disclosure relates to removing functionality of a ceramic disk installed in a wellbore utilizing fluid jetting.

BACKGROUND

During hydrocarbon well drilling and completion activities, production casing and production tubing is installed in a wellbore. Prior to production packer installation, ceramic disks are installed to maintain pressure and isolate the production tubing for wellbore operations. Once production packers are installed in the production casing, the ceramic disk is broken so that well flowback operations can begin.

Ceramic disks are generally ruptured with milling tools directed downhole with coiled tubing. Milling tools are drill-like tools that mechanically destroy the disk. The conventional method of milling results in the use of heavy equipment, takes substantial time and energy, and results in debris formation in the wellbore. The conventional method of milling can also result in complications related to coil tubing getting locked-up (or stuck) within a wellbore, or breakage of heavy equipment, including the milling equipment, during the operation. Due to the physical contact between the milling tools and the ceramic disk, there is an increased chance of a milling tool breaking down or getting physically stuck within the production tubing while performing the breaking of the ceramic disk, resulting in substantial damage to equipment and significant delays while the tools are removed. Additionally, it can take substantial time and energy to lower milling tools downhole, and other downhole operations may not be able to be performed downhole when the milling is being performed, or when the milling tool is lowered downhole. Due to the long tool transit time downhole and due to the increased risk of damage or lock-up from use of the milling tools in the wellbore, breaching a ceramic disk installed downhole without the use of milling tools is advantageous. Other conventional ways of breaching the ceramic disk include using go-devils or dropped bars, which break the disk. These conventional methods, however, are prone to experience issues and cannot be utilized in diverted, angled, or otherwise non-linear wellbores. Therefore, additional methods of rupturing ceramic disks downhole are desired.

SUMMARY

The disclosure relates to systems and methods for removing the functionality of a ceramic disk installed in a wellbore during oil and gas well completion and production activities. More specifically, the disclosure relates to rupturing a ceramic disk with a tool that directs high pressure fluids with entrained solids at the ceramic disk until structural failure. A jetting device, or tool, is lowered downhole, and fluids with entrained solids are directed at high pressure through the tool to the ceramic disk. As explained previously, there are substantial time, energy costs, and other disadvantages associated with conventional milling of ceramic disks; therefore other systems and methods that rupture ceramic disks downhole without the use of milling tools, such as the embodiments disclosed herein, are desired.

Therefore, disclosed herein is a method of breaching a ceramic disk installed in a wellbore. The ceramic disk is operable to maintain pressure within the wellbore during a wellbore operation. The method includes the step of lowering a jetting device into the wellbore. The jetting device is operable to generate a pressurized jet of jetting fluid having a jet pressure. The jetting fluid includes fluid and entrained solids. The entrained solids include barite. The method also includes the steps of directing the pressurized jet at the ceramic disk and breaching the ceramic disk with the pressurized jet so that the ceramic disk is no longer operable to maintain pressure within the wellbore.

In some embodiments, the fluid includes drilling fluid. In some embodiments, the fluid includes gel additives. The method also includes the step of generating the pressurized jet at a pressure greater than a required uniaxial stress of the ceramic disk, where the ceramic disk has a required uniaxial stress, and where the required uniaxial stress is an amount of stress needed to break the ceramic disk. The required uniaxial stress is determined by tensile testing of the ceramic disk. The jetting device does not come into contact with the ceramic disk during the step of breaching the ceramic disk.

In some embodiments, the jet pressure is at least 500 psig. In other embodiments, the jet pressure is in the range of 500 psig to 5000 psig. The jetting fluid contains up to 10% by weight entrained solids.

Further disclosed herein is a system for breaching a ceramic disk installed in a wellbore for a wellbore operation. The system includes the ceramic disk installed within the wellbore, where the ceramic disk is operable to maintain pressure during the wellbore operation. The system also includes a jetting device operable to generate a pressurized jet of jetting fluid having a jet pressure, and the jetting fluid. The jetting fluid includes fluid and entrained solids. The entrained solids include barite. The jetting fluid is operable to breach the ceramic disk when the pressurized jet of jetting fluid is directed at the ceramic disk.

In some embodiments, the fluid includes drilling fluid. In some embodiments, the fluid includes gel additives. The jetting device is operable to generate the pressurized jet of jetting fluid having the jet pressure at a greater pressure than a required uniaxial stress of the ceramic disk. The required uniaxial stress is an amount of stress needed to break the ceramic disk. The jetting device does not come into contact with the ceramic disk during the generation of the pressurized jet of jetting fluid.

In some embodiments, the jet pressure is at least 500 psig. In some embodiments, the jet pressure is in the range of 500 to 5000 psig. The jetting fluid contains up to 10% by weight entrained solids. The jetting device further assists downhole as a maneuvering tool.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the scope as it can admit to other equally effective embodiments.

In the accompanying Figures, similar components or features, or both, can have a similar reference label. For the purpose of the simplified schematic illustrations and descriptions of FIGS. 1A through 2, the numerous pumps, valves, temperature and pressure sensors, electronic controllers, and the like that can be employed and well known to those of ordinary skill in the art are not included. Further, accompanying components that are in conventional industrial operations are not depicted. However, operational components, such as those described in the present disclosure, can be added to the embodiments described in this disclosure.

DETAILED DESCRIPTION

While the disclosure will be described with several embodiments, it is understood that one of ordinary skill in the relevant art will appreciate that many examples, variations and alterations to the systems and methods described are within the scope and spirit of the disclosure. Accordingly, the embodiments of the disclosure described are set forth without any loss of generality, and without imposing limitations, on the claims.

Advantages of the present disclosure include a non-contact physical breaking of the ceramic disk, potential long-distance intervention and breaking of the ceramic disk, and elimination of heavy downhole milling tools. There is no physical contact between the jetting device and the ceramic disk when the jet is activated, substantially reducing the risk of a tool breaking, a tool getting stuck in the wellbore, damage to the wellbore, and complications from debris or broken tools. Additionally, in some embodiments, the jetting device can have dual functionality. For example, the jetting device can serve as a maneuvering tool in addition to serving as a penetration tool to break the ceramic disk. Maneuvering can be performed by controlling the exit of fluid out of any of the openings of the tool. The exiting fluid interacts with fluids inside the borehole applying sufficient force to move the tool through the wellbore. The use of the tool as a maneuvering support is especially helpful in highly deviated and horizontal wells where gravity does not play any crucial role without the use of drillpipe, coiled tubing, or tractor tires. The tool can also be used in a longer tool string allowing for maneuvering of additional tools downhole during the ceramic disk breaking procedure. Additionally, the embodiments disclosed herein can be deployed in oil and gas wellbores and with ceramic disks already known and used in the field—no special ceramic disk or wellbore operating techniques are required. The jetting fluid utilized does not require chemicals to erode, degrade, or otherwise react with the ceramic disk. In some wellbores, it is advantageous to not use chemicals within the wellbore due to the formation or the location of the wellbore. Also, the jetting device can be used in deviated or horizontal wellbores, unlike go-devils or other dropped tools.

Figure 1B:
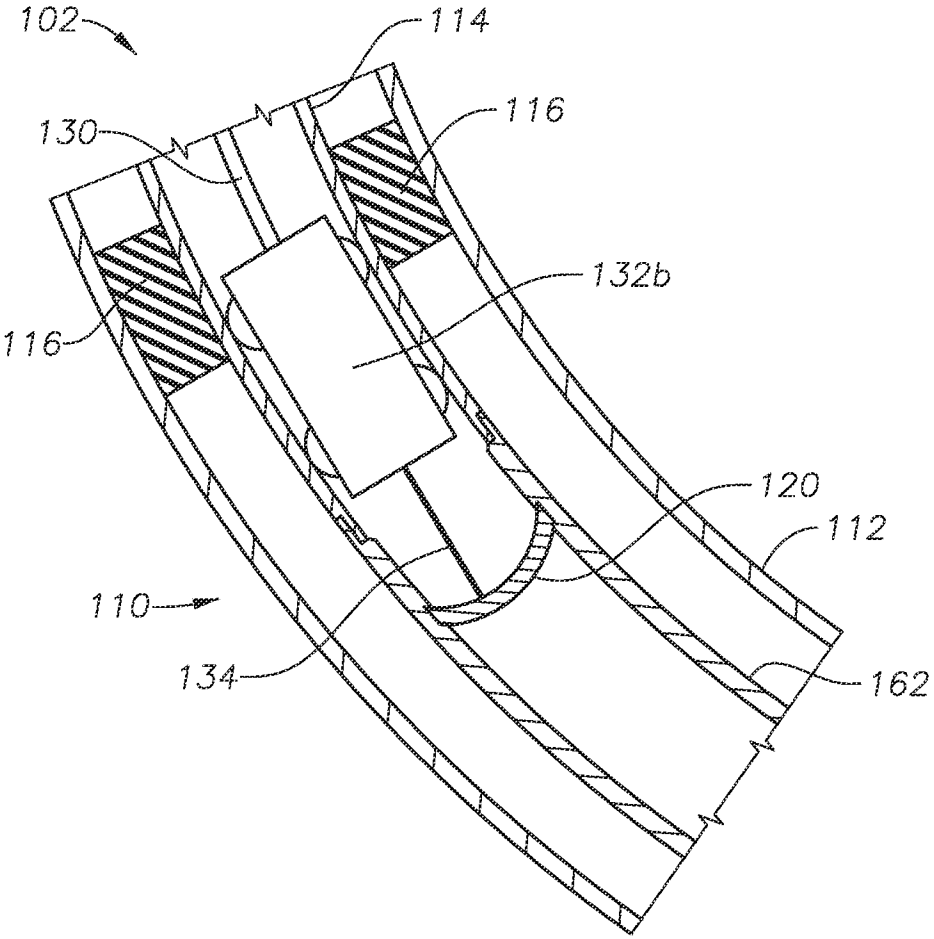
FIG. 1B is a schematic of a horizontal wellbore fluid jetting system, according to an embodiment.
Figure 1A:
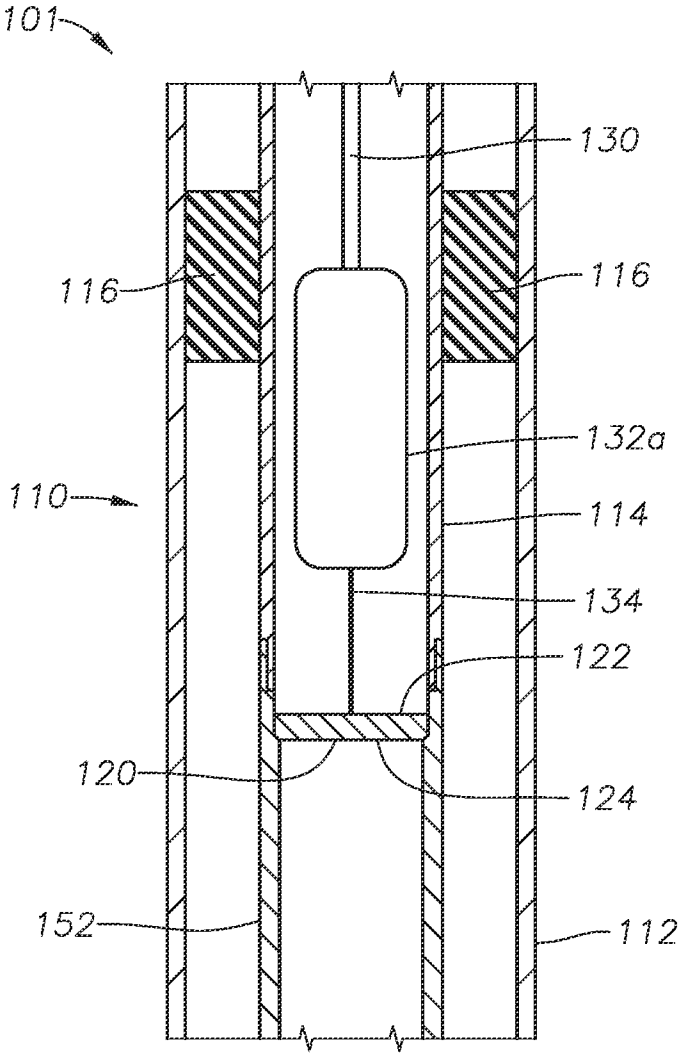
FIG. 1A is a schematic of a vertical wellbore fluid jetting system, according to an embodiment.

Referring to FIG. 1A, vertical wellbore fluid jetting system 101 is depicted. Wellbore 110 includes production casing 112 and production tubing 114. Installed in the annulus between production casing 112 and production tubing 114 are packers 116. Installed within production tubing 114 is ceramic disk 120. Ceramic disk 120 can be any type of disk capable of maintaining pressure in production tubing 114 while the wellbore operation is being performed. Ceramic disk 120 can be made of ceramic material capable of being subjected to fluid jetting until structural failure and rupture. The wellbore operation can include packer installation, wellbore isolation sub installation, logging operations, other well completion or production activities, or other downhole activities where isolation is required or pressure must be maintained within the wellbore. In some preferred embodiments, ceramic disk 120 is made of a ceramic material known in the art. The ceramic material can include any type of ceramic material known in the art suitable for downhole conditions. The ceramic material can include aluminum oxide, aluminum titanate, silicon carbide, silicon nitride, similar ceramic materials, or combinations of the same. Ceramic disk 120 is a flat, plate-like disk wedged within production tubing 114; however, ceramic disk 120 can be any shape or size. In some embodiments, ceramic disk 120 is a semispherical shape or a convex/concave shape, where the convex side faces the higher of the pressures within the wellbore. Ceramic disk 120 has uphole side 122, which faces in the uphole direction of wellbore 110. Ceramic disk 120 also has downhole side 124, which faces in the downhole direction of wellbore 110. In this embodiment, ceramic disk 120 is installed in nipple 152. Ceramic disk 120 can be installed by methods known in the art, including installation during production tubing installation. In some embodiments, ceramic disk 120 is installed in production tubing 114 at the surface.

Tool string 130 is deployed into production tubing 114. Tool string 130 can include wireline, slickline, coiled tubing, similar devices, and combinations of the same. In some embodiments, tool string 130 includes conduits through which specific fluids can be delivered to downhole devices. In some embodiments, tool string 130 includes mechanisms which can supply power to downhole devices or which can provide signals to control downhole devices. Tool string 130 is connected to jetting tool 132*a*. Jetting tool 132*a* is a jetting device. A jetting device can be any tool capable of generating a jet of pressurized fluid. Some jetting devices which can be used in the systems and methods disclosed herein are described in U.S. Pat. No. 9,624,743, which is incorporated herein by reference in its entirety. Jetting tool 132*a* is lowered into wellbore 110 towards ceramic disk 120. Jetting tools 132*a* does not physically contact ceramic disk 120 during jetting and breaching operations. The exact depth of ceramic disk 120 in wellbore 110 or the exact depth of jetting tool 132*a* is lowered in wellbore 110 can be determined by methods known in the art, such as case coil lock. In some embodiments, jetting tool 132*a* is lowered into wellbore 110 so that the distance between jetting tool 132*a* and ceramic disk 120 is less than about 500 feet, alternately less than about 400 feet, alternately less than about 300 feet, alternately less than about 250 feet, alternately less than about 200 feet, alternately less than about 150 feet, and alternately less than about 100 feet. In a preferred embodiment, the distance between jetting tool 132*a* and ceramic disk 120 is in the range of 100 to 200 feet.

Jetting tool 132*a* generates fluid jet 134. Fluid jet 134 is a pressurized jet of jetting fluid. The pressurized jet of jetting fluid has a jet pressure. In some embodiments, the jet pressure is greater than 500 psig. In some embodiments, the jet pressure is in the range of 500 psig to 10,000 psig; alternately 500 psig to 5,000 psig; alternately 500 psig to 2,500 psig; alternately 750 psig to 5,000 psig; and alternately 750 psig to 2,500 psig. The pressure ranges utilized will not damage the wellbore completions, including the production tubing and casing.

The jetting fluid can contain any type of fluid, including pressurized gases. In preferred embodiments, the jetting fluid includes a liquid. The liquid can be water, drilling fluid, drilling mud, oil, potassium chloride solution, formation water, or combinations of the same. In some embodiments, the fluid contains gel additives. The gel additives can be linear gels, nitrified linear gels, or crosslinked gels. The gel additives can assist in maintaining the entrained solids in the fluid. In some embodiments, the jetting fluid can include nitrified water slugs, or continuous nitrified water streams. The jetting fluid modeling is an important aspect to control the settling velocity of the entrained solids. The settling velocity is heavily dependent on the wellbore inclination, as the higher the inclination, the higher the bulk fluid velocity over the particle settling velocity ratio will be (Vbf/Vps). In some embodiments, the jetting fluid does not contain chemicals that chemically erode, react with, or otherwise chemically interact with the material of ceramic disk 120.

The jetting fluid also contains entrained solids. The entrained solids can include any type of small particulates. In some embodiments, the entrained solids include bentonite. In some embodiments, the entrained solids include sand. In preferred embodiments, the entrained solids include barite. The barite increases viscosity of the fluid. The barite used can include barium sulfate ($BaSO_4$). The barite can have a density in the range of 4.48 g/cm, and a hardness in the range of 3 to 3.5 on the Mohs scale. Alkaline salts can be added to the barite to prevent damage to the tools or to the formation. In some embodiments, the alkaline salts added can be up to 250 mg/kg or $250\times10^{-6}$. In some embodiments, 97% of the entrained solids can pass through a 75 μm screen. In a preferred embodiment, no more than 30% by weight of the entrained solids are less than 6 μm in diameter. In some embodiments, the entrained solids are up to 10% by weight of the jetting fluid. In preferred embodiments, the specific gravity of the jetting fluid including the entrained solids should exceed 4.2. Without being bound by theory, the entrained solids assist in increasing the amount of force delivered by the pressurized jet of fluid to ceramic disk 120.

Fluid jet 134 is directed at ceramic disk 120. When fluid jet 134 contacts ceramic disk 120, the force applied from the pressure of fluid jet 134 over the area of ceramic disk 120 exceeds the required uniaxial stress of ceramic disk 120, resulting in structural failure of ceramic disk 120, and the subsequent release of pressure as ceramic disk 120 can no longer maintain pressure within the wellbore. The required uniaxial stress of ceramic disk 120 is the amount of stress under which ceramic disk 120 breaks due to force applied to the surface. The required uniaxial stress of ceramic disk 120 can be determined by tensile testing in a laboratory setting. Alternately, the required uniaxial stress of ceramic disk 120 can be determined by reviewing the physical properties of the ceramic material. In some preferred embodiments, the jet pressure of the fluid jet exceeds the fluid pressure of the wellbore downhole of the ceramic disk by between 200 to 500 psi to overcome the pressure of the wellbore contained by the ceramic disk, in addition to taking into consideration the differential pressure between the two sides of the ceramic disk. In some embodiments, there are no fluids uphole of ceramic disk 120. In some embodiments, circulation can be applied of the pressure above and below ceramic disk 120 is too high. Fluid jet 134 does not erode or corrode ceramic disk 120, and instead physically fractures or breaks ceramic disk 120 by exerting enough force to break ceramic disk 120.

Referring to FIG. 1B, horizontal wellbore fluid jetting system 102 is depicted, and shares many of the same elements and characteristics of vertical wellbore fluid jetting system 101. Wellbore 110 is a horizontal wellbore, and ceramic disk 120 is a curved, semi-spheric disk. Ceramic disk 120 is installed in disk sub 160. The methods disclosed herein can be applied for horizontal wellbore fluid jetting system 102. Tool string 130 is connected to jetting tractor 132*b*. Tool string 130 and jetting tractor 132*b* operate similarly as the similar elements described for vertical wellbore fluid jetting system 101. The jetting device in horizontal wellbore fluid jetting system 102 is jetting tractor 132*b*. Jetting tractor 132*b* is a jetting device capable of generating a jet of pressurized fluid, similar to the jet of pressurized fluid generated in vertical wellbore fluid jetting system 101.

Jetting tractor 132*b* generates fluid jet 134, which is generated and operates similarly as the similar elements described for vertical wellbore fluid jetting system 101. Due to the straight path of fluid jet 134 and the non-linear path of wellbore 110, jetting tractor 132*b* is positioned closer to ceramic disk 120 to prevent fluid jet 134 from impacting production tubing 114. In some embodiments, jetting tractor 132*b* is lowered into wellbore 110 so that the distance between jetting tractor 132*b* and ceramic disk 120 is less than about 500 feet, alternately less than about 400 feet, alternately less than about 300 feet, alternately less than about 200 feet, alternately less than about 150 feet, and alternately less than about 100 feet, alternately less than about 50 feet, and alternately less than about 20 feet. In a preferred embodiment, the distance between jetting tool 132*a* and ceramic disk 120 in horizontal wellbore fluid jetting system 102 is in the range of 100 to 200 feet.

Figure 2:
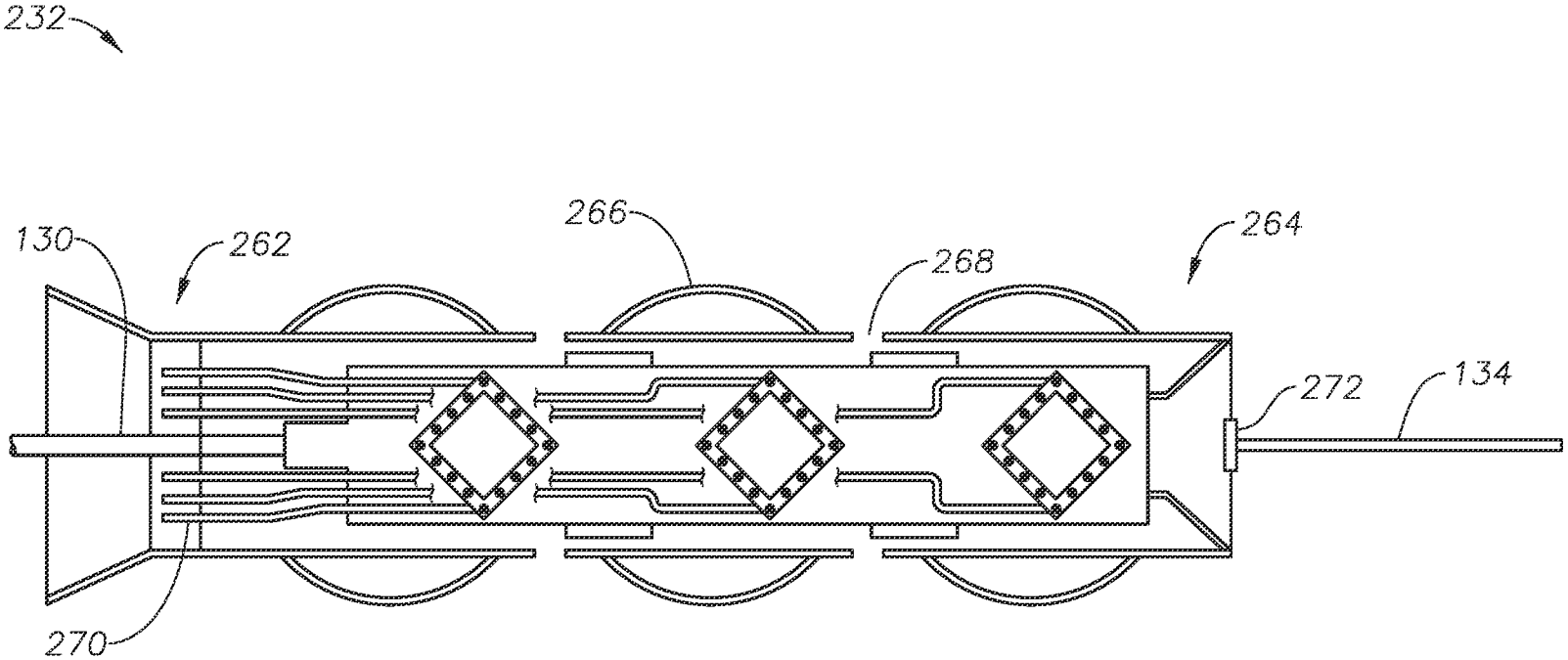
FIG. 2 is a schematic of a guided jetting tractor, according to an embodiment.

Referring to FIG. 2, a cross section of guided jetting tractor 232 is depicted. Guided jetting tractor 232 is a jetting device, and can be utilized within the systems and methods disclosed herein. Guided jetting tractor 232 is a generally cylindrical tool. Guided jetting tractor 232 includes uphole end 262, which is connected to tool string 130. Uphole end 262 is generally positioned uphole of downhole end 264, which is generally positioned downhole of the wellbore. Guide fences 266 are spaced on the outer structure of guided jetting tractor 232, and can be curved members. Each guide fence 266 has two ends, each attached to the outer surface of guided jetting tractor 232. The curved middle portion of each guide fence 266 protrudes outward from the outer surface of guided jetting tractor 232. Guide fences 266 are sized and spaced to keep guided jetting tractor 232 centered within the wellbore.

Guided jetting tractor 232 includes a plurality of outer openings 268, which allow for fluid flow from inside guided jetting tractor 232 to outside of the tractor and into the wellbore. The flow of fluid from outer openings 268 interacting with the fluids inside of the wellbore applies sufficient force to move guided jetting tractor 232 through the wellbore.

Guided jetting tractor 232 includes fluid lines 270 which deliver fluid to and through guided jetting tractor 232. Guided jetting tractor 232 generates fluid jet 134 from downhole jet opening 272, located at downhole end 264. Guided jetting tractor 232 can include a pump (not pictured) which assists in providing appropriate jet pressure to fluid jet 134.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

As used in the specification and in the appended claims, the words "comprise," "has," and "include" and all grammatical variations thereof are each intended to have an open, non-limiting meaning that does not exclude additional elements or steps.

Ranges may be expressed throughout as from about one particular value, or to about another particular value. When such a range is expressed, it is to be understood that another embodiment is from the one particular value or to the other particular value, along with all combinations within said range.

What is claimed is:

1. A method of breaching a ceramic disk installed in a wellbore, the ceramic disk operable to maintain pressure within the wellbore during a wellbore operation, the method comprising the steps of:

lowering a jetting device into the wellbore, the jetting device operable to generate a pressurized jet of jetting fluid having a jet pressure, the jetting fluid comprising fluid and entrained solids, wherein the entrained solids comprise barite;

directing the pressurized jet at the ceramic disk; and breaching the ceramic disk with the pressurized jet such that the ceramic disk is no longer operable to maintain pressure within the wellbore.

2. The method of claim 1, wherein the fluid comprises drilling fluid.

3. The method of claim 1, wherein the fluid comprises gel additives.

4. The method of claim 1, further comprising the step of:

generating the pressurized jet at a pressure greater than a required uniaxial stress of the ceramic disk;

wherein the ceramic disk has a required uniaxial stress, and further wherein the required uniaxial stress is an amount of stress needed to break the ceramic disk.

5. The method of claim 4, wherein the required uniaxial stress is determined by tensile testing of the ceramic disk.

6. The method of claim 1, wherein the jetting device does not come into contact with the ceramic disk during the step of breaching the ceramic disk.

7. The method of claim 1, wherein the jet pressure is at least 500 psig.

8. The method of claim 1, wherein the jet pressure is in the range of 500 psig to 5000 psig.

9. The method of claim 1, wherein the jetting fluid comprises up to 10% by weight of the entrained solids.

10. A system for breaching a ceramic disk installed in a wellbore for a wellbore operation, the system comprising:

the ceramic disk installed within the wellbore, the ceramic disk operable to maintain pressure during the wellbore operation;

a jetting device, the jetting device operable to generate a pressurized jet of jetting fluid having a jet pressure; and the jetting fluid comprising fluid and entrained solids, wherein the entrained solids comprise barite, the jetting fluid operable to breach the ceramic disk when the pressurized jet of jetting fluid is directed at the ceramic disk.

11. The system of claim 10, wherein the fluid comprises drilling fluid.

12. The system of claim 10, wherein the fluid comprises gel additives.

13. The system of claim 10, wherein the jetting device is operable to generate the pressurized jet of jetting fluid having the jet pressure at a greater pressure than a required uniaxial stress of the ceramic disk, wherein the required uniaxial stress is an amount of stress needed to break the ceramic disk.

14. The system of claim 10, wherein the jetting device does not come into contact with the ceramic disk during the generation of the pressurized jet of jetting fluid.

15. The system of claim 10, wherein the jet pressure is at least 500 psig.

16. The system of claim 10, wherein the jet pressure is in the range of 500 psig to 5000 psig.

17. The system of claim 10, wherein the jetting fluid comprises up to 10% by weight of the entrained solids.

18. The system of claim 10, wherein the jetting device further assists downhole as a maneuvering tool.

* * * * *